US005783503A

United States Patent [19]

Gillespie et al.

[11] Patent Number: 5,783,503

[45] Date of Patent: Jul. 21, 1998

[54] MELTSPUN MULTICOMPONENT THERMOPLASTIC CONTINUOUS FILAMENTS, PRODUCTS MADE THEREFROM, AND METHODS THEREFOR

[75] Inventors: Jay Darrell Gillespie, Simpsonville, S.C.; David Bruce Christopher, Camas, Wash.; Harold Edward Thomas, Greer; John Henry Phillips, Greenville, both of S.C.; Scott Louis Gessner, Encinitas, Calif.; Lloyd Edwin Trimble, Gilbert, Ariz.; Jared Asher Austin, Greer, S.C.

[73] Assignee: Fiberweb North America, Inc., Simpsonville, S.C.

[21] Appl. No.: 681,244

[22] Filed: Jul. 22, 1996

[51] Int. Cl.[6] ..... D04H 1/58; D02G 3/00

[52] U.S. Cl. ..... 442/340; 442/338; 442/341; 442/345; 442/351; 442/373; 442/374; 442/394; 442/359

[58] Field of Search ..... 428/373, 374, 428/394; 442/327, 340, 341, 342, 351, 338

[56] References Cited

U.S. PATENT DOCUMENTS

| | | |
|---|---|---|
| 3,853,977 | 12/1974 | Matsui et al. . |
| 3,900,678 | 8/1975 | Aishima et al. . |
| 4,073,988 | 2/1978 | Nishida et al. . |
| 4,109,038 | 8/1978 | Hayashi et al. . |
| 4,127,696 | 11/1978 | Okamoto . |
| 4,165,556 | 8/1979 | Nishida et al. . |
| 4,216,264 | 8/1980 | Naruse et al. . |
| 4,233,355 | 11/1980 | Sato et al. . |
| 4,239,720 | 12/1980 | Gerlach et al. . |
| 4,241,122 | 12/1980 | Asano . |
| 4,246,219 | 1/1981 | Yu et al. . |
| 4,269,888 | 5/1981 | Ejima et al. . |
| 4,293,614 | 10/1981 | Plischke et al. . |
| 4,318,949 | 3/1982 | Okamoto et al. . |
| 4,352,705 | 10/1982 | Ozaki et al. . |
| 4,368,227 | 1/1983 | Setsuie et al. . |
| 4,381,335 | 4/1983 | Okamoto . |
| 4,390,572 | 6/1983 | Okamoto et al. . |
| 4,407,889 | 10/1983 | Gintis et al. . |
| 4,457,974 | 7/1984 | Summers . |
| 4,460,649 | 7/1984 | Park et al. . |
| 4,476,186 | 10/1984 | Kato et al. . |
| 4,496,619 | 1/1985 | Okamoto . |
| 4,557,972 | 12/1985 | Okamoto et al. . |
| 4,604,320 | 8/1986 | Okamoto et al. . |
| 4,612,688 | 9/1986 | Gerlach et al. . |
| 4,822,678 | 4/1989 | Brody et al. . |
| 5,047,189 | 9/1991 | Lin . |
| 5,075,161 | 12/1991 | Nyssen et al. . |
| 5,124,194 | 6/1992 | Kawano . |
| 5,162,074 | 11/1992 | Hills . |
| 5,188,895 | 2/1993 | Nishino et al. . |
| 5,275,884 | 1/1994 | Nishino et al. . |
| 5,290,626 | 3/1994 | Nishio et al. . |
| 5,354,617 | 10/1994 | Ikkanzaka et al. . |
| 5,418,045 | 5/1995 | Pike et al. . |
| 5,534,339 | 7/1996 | Stokes . |

*Primary Examiner*—Marion E. McCamish
*Assistant Examiner*—J. M. Gray
*Attorney, Agent, or Firm*—Bell Seltzer Intellectual Property Law Group of Alston & Bird LLP

[57] ABSTRACT

Multicomponent thermoplastic continuous filaments are provided, including hollow core multicomponent filaments. The filaments are at least partially splittable into smaller filaments in the absence of mechanical treatment or application of high pressure water jets. The surface energy of the components can be controlled to control separation of the multi-component filaments. Sub-denier and micro-denier filaments of low orientation can be produced from relatively high molecular weight polymers to produce nonwovens of surprising strength, barrier, and cover.

19 Claims, 12 Drawing Sheets

MELTSPUN MULTICOMPONENT THERMOPLASTIC CONTINUOUS FILAMENTS, PRODUCTS MADE THEREFROM, AND METHODS THEREFOR

FIELD OF THE INVENTION

The invention relates to multicomponent fibers, methods for making and splitting these fibers, products made from the fibers, and methods for making these products.

BACKGROUND OF THE INVENTION

Hills U.S. Pat. No. 5,162,074 discloses a spin pack that is said to be suitable for both melt spinning and solution spinning of splittable multicomponent fibers in a wide variety of configurations.

The spin pack includes thin metal distributor plates in which distribution flow paths are etched rather than machined or cut to provide precisely formed and densely packed passage configurations. The distribution flow paths include etched shallow distribution channels arranged for polymer flow along the distributor plate surface in a direction transverse to the net flow through the spin pack. The polymer reaches the orifices in the spinneret plate through distribution apertures that are etched through the distributor plates. The distributor plates are disposable and are said to provide an economical means for extruding multicomponent fibers in a wide variety of configurations by either melt spinning or solution spinning.

The etched distributor plates of the Hills patent are said to facilitate the preparation from splittable multicomponent fibers of micro-fiber staple of 0.1 denier per micro-fiber and in which each micro-fiber has only one polymer component. Polymers selected to bond weakly to one another and extruded in a checkerboard pattern are said to be separated into multiple micro-fibers by mechanical working or high pressure water jets. Alternatively, the multicomponent fiber can be treated with a solvent to dissolve one of the components, leaving micro-fibers of the undissolved polymer component.

Nylon and polyester are suggested for preparing micro-fiber staple and some examples are shown of sheath-core fibers, which typically are not splittable except by solvent dissolution of one component. Several variations on side-by-side and "segmented pie" bicomponent fiber configurations are said to be splittable by subjecting the fibers to mechanical working.

The Hills patent recognizes that the mechanical working methods disclosed in the patent for splitting bicomponent fibers, including drawing, beating, and calendering, have previously been suggested in the art. The Hills disposable distributor plate is said to provide micro-fiber production at less expense than these prior processes.

The etched distributor plates described in the Hills patent are said to produce a wide variety of multicomponent fiber configurations at reasonable cost and polymer throughput. However, the Hills patent shows no working examples of micro-denier fibers prepared from multicomponent fibers by mechanical working.

Even assuming that the prior art mechanical splitting methods taught in the Hills patent could work to split fibers produced in accordance with the Hills patent, the necessity of treating the fibers by the known mechanical means, including drawing on Godet rolls, beating, or carding to separate the fibers, is a serious drawback that introduces complexity and expense into fiber spinning processes, can damage or weaken the fibers, and limits the usefulness of the Hills invention.

Mechanical treatments substantially preclude commercially productive use of the Hills invention for certain manufacturing processes and products, including melt spinning processes for producing spun-laid and spun-bonded continuous filament nonwovens. For example, spun-laid and spun-bonded products typically are prepared from thermoplastic continuous filaments that are extruded through a spinneret, drawn in an air attenuation step, and deposited on a collection surface in the absence of a mechanical working step or application of high pressure water jets.

SUMMARY OF THE INVENTION

This invention is based on the recognition that, in multicomponent fibers, points of adhesion between areas of like polymer substantially limit the ability of the fiber producer to split these fibers, even using Godet rolls, beating, or carding. The invention provides multicomponent thermoplastic continuous filaments that can be produced by meltspinning, including splittable filaments that do not require the mechanical treatments or high pressure water jets disclosed in the Hills patent for separation into smaller filaments. Chemical, mechanical, or electrical properties of the multicomponent filaments are controlled to control the surface energy of the components to promote separation of the filaments.

The filaments of the invention include sub-denier or micro-denier filaments of increased strength, softness, and barrier that can be used in a variety of products having surprising properties, including products prepared from spun-laid and spun-bonded nonwovens. Typically, micro-denier filaments have been produced using melt blowing technology. Micro-denier filaments obtained from melt blowing processes typically are obtained with relatively low molecular weight polymers. In contrast, the micro-denier continuous filaments of the invention have a low orientation and can be obtained from the relatively high molecular weight polymers typically associated with spunbonding processes.

The invention has application in melt spinning processes using any of several available technologies for producing bicomponent or other multicomponent filaments and that typically use air or other gaseous media such as steam to transport filaments from a spinneret and to draw and attenuate the filaments. The invention also has application in the production of textile yarns and tow for staple where the filaments are drawn through a texturing jet or other similar device in which the filaments are subjected to treatment by a pressurized gas.

In one aspect, the invention provides hollow multicomponent thermoplastic continuous filaments. In an additional aspect, the hollow multicomponent thermoplastic continuous filaments comprise at least two components arranged in alternating segments about a hollow core. The components may be selected to promote splitting into smaller filaments, including micro-filaments, if desired. However, these filaments are also useful without splitting or with only partial splitting.

In another aspect, the invention provides multicomponent thermoplastic continuous filaments that can be split into smaller filaments upon exiting a spinneret in free fall from the spinneret, by drawing and stretching or attenuating the filaments in a pressurized gaseous stream, including air or steam, by developing a triboelectric charge in at least one of the components, by application of an external electrical field, or by a combination of some or all of these.

Additional aspects of the invention include methods for producing the thermoplastic continuous filaments. A method for producing thermoplastic continuous filaments comprises extruding at least two thermoplastic components through a spinneret into multicomponent filaments. At least a portion of the multicomponent filaments are split into smaller filaments substantially in the absence of mechanical working or high pressure water jets.

Splitting can be accomplished in free fall from the spinneret, by transporting the extruded filaments through a pressurized gaseous stream, by developing a triboelectric charge in at least one of the components that facilitates splitting of the filaments, by applying an external electrical field to the filaments, and combinations thereof.

In additional aspects, the invention includes the useful products that can be produced with the filaments of the invention and methods for producing these products. Products that can be produced with the filaments of the invention include continuous filament nonwoven webs, textile yarns, and tow for staple. Nonwoven webs can be prepared in which a single layer of the web has spun-laid or spun-bonded micro-denier filaments present. The webs include first and second smaller filaments that originate from a common capillary in the spinneret. Each of the first and second filaments includes at least one component of a parent multicomponent filament. The smaller filaments may include monocomponent filaments and/or those filaments with the first and second components present. The nonwoven webs of the invention have surprisingly increased tensile, softness, barrier properties, and water transport properties compared to typical spun-laid and spun-bonded webs that have a single component.

Continuous filament nonwoven webs can be prepared by extruding splittable multicomponent thermoplastic filaments and splitting at least a portion of the multicomponent filaments into a plurality of smaller filaments. Splitting is accomplished substantially in the absence of mechanical working or high pressure water jets. The filaments are then transported through a gaseous stream and deposited on a collection surface to form a web.

Continuous filament textile yarns and tow for staple are similarly prepared. However, textile yarns typically are at least partially split in the pressurized gaseous stream of a yarn texturing jet or other somewhat similar device. The filaments are not deposited on a collection surface to form a web, but are collected to form yarn and tow.

Thus, the invention provides hollow multicomponent thermoplastic continuous filaments, multicomponent thermoplastic continuous filaments in the absence of a hollow core that are splittable so as to be useful in processes that do not employ high pressure water jets or mechanical working to split the filaments, methods for making these filaments, products made from these filaments, and methods for making these products.

BRIEF DESCRIPTION OF THE DRAWINGS

Some of the features and advantages of the invention have been stated. Other advantages will become apparent as the description of the invention proceeds taking into conjunction the accompanying drawings, in which.

DETAILED DESCRIPTION OF THE PREFERRED EMBODIMENTS

The invention will now be described more fully with reference to the accompanying drawings which illustrate various embodiments of the invention.

Figure 1:
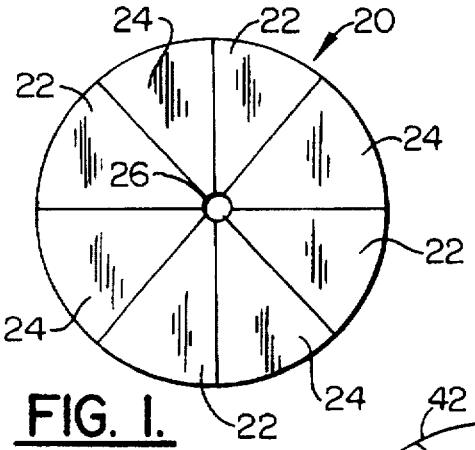
FIG. 1 illustrates a transverse cross section through a hollow core multicomponent thermoplastic continuous filament of the invention.

FIG. 1 is a representation of a transverse section through a hollow core multicomponent thermoplastic continuous filament 20 of the invention. The multicomponent filament of FIG. 1 is a bicomponent filament in a "segmented pie" configuration having eight pie shaped wedges of two different thermoplastic polymeric components 22 and 24 arranged in alternating segments about a hollow core 26. No areas of like components touch in the hollow core embodiment, so there are no areas of adhesion between like component segments. Splitting of the filament is enhanced.

It should be recognized that more than eight or less than eight segments can be produced in filaments made in accordance with the invention. It should also be recognized that more than two components can be used, so long as commercially practicable.

There are many variations on the segmented pie configuration that are amenable to practice of the present invention. As an example, Hills U.S. Pat. No. 5,162,074 shows a segmented pie configuration at FIG. 43 and variations thereon in FIGS. 44 through 47. A suitable hollow core prepared in any of these filament configurations substantially to eliminate areas of adhesion of like components should result in a filament that begins to separate on exiting a spinneret and can be fully separated or nearly fully separated by the methods discussed below. At least partial separation of multicomponent thermoplastic filaments in the absence of a hollow core can occur under appropriate conditions, as discussed below.

A hole in the center of each filament is achieved through the use in connection with apparatus for preparing bicomponent or other multicomponent filaments of a spinneret orifice that is designed to produce a hollow core filament. Hollow core spinnerets are well known to the skilled artisan in connection with monocomponent filaments. The hollow core prevents the tips of the wedges of like components from contacting each other at the center of the filament and promotes separation of the filament components as the filaments exit the spinneret.

The ease with which a bicomponent or other multicomponent filament can be formed and then split depends upon several factors, including the miscibility of the components, differences in melting points of the components, crystallization properties, viscosity, conductivity, and the ability to develop a triboelectric charge. Differences in crystallization properties include the rates of crystallization of the different components and the degree to which the component crystallizes, which is also called absolute crystallinity. Differences in conductivity can result in different responses to the components to an externally applied electrical field, which can augment separation of the components.

The polymeric components for splittable filaments are selected in proportions and to have melting points, crystallization properties, electrical properties, viscosities, and miscibilities that will enable the multicomponent filament to be spun and will promote ease of separation to the desired degree. Suitable polymers for practice of the invention include polyolefins, including polypropylene and polyethylene, polyamides, including nylon, polyesters, including polyethylene terephthalate and polybutylene terephthalate, thermoplastic elastomers, copolymers thereof, and mixtures of any of these with additives that alter the surface energy and adhesion characteristics of the polymer, copolymer or elastomer to promote splitting. These properties can include crystallization properties or electrical properties of the polymer, copolymer, or elastomer. Polycarbonates and polyurethanes can be expected to perform equally well since the surface energies of these thermoplastic polymers can be controlled similarly to polyesters and nylons.

Suitable combinations of polymers for bicomponent filaments include polyester and polypropylene, polyester and polyethylene, nylon and polypropylene, nylon and polyethylene, and nylon and polyester. These combinations provide particularly desirable, but by no means all, combinations for splittable bicomponent filaments. Thermoplastic elastomers can be incorporated for stretch properties and to promote splitting.

Copolymers of the above polymers can be used to bring the melting points of the polymers closer together for ease in forming the filaments and to reduce encapsulation of one component by another. Also it should be recognized that the properties of one or more polymers can be manipulated to limit areas of adhesion and to promote separation of the component filaments.

The properties of a single polymer can be manipulated by the addition of various modifiers to, in effect, create polymers of suitably different properties that do not adhere well to each other for use in the practice of the invention. For example, a single polymer can be used for first and second components with suitable additives to control the surface free energy, electrical properties or crystallization so as to produce a splittable filament. Additives can be incorporated into a polyethylene melt substantially to alter the rate of crystallization of the polymer on exiting a spinneret.

Figure 2:
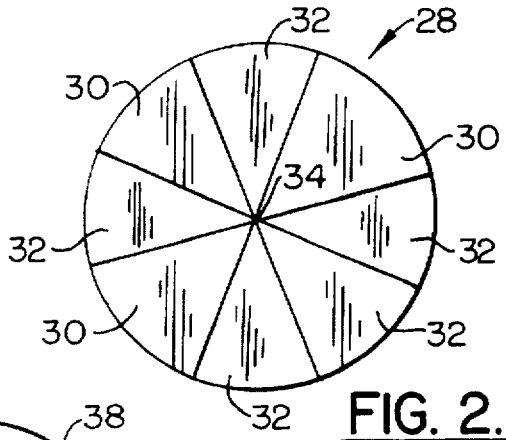
FIG. 2 represents a filament similar to that of FIG. 1, but in the absence of a hollow core.

FIG. 2 is a representation of a transverse section through a multicomponent thermoplastic filament 28 of the invention having components 30 and 32 similar to that of FIG. 1, but in the absence of a hollow core. In comparison, there are no points of adhesion between like component segments in FIG. 1, whereas in the bicomponent embodiment of FIG. 2, four like component segments 30, and four like components 32, which are different from components 30, join at the center 34. These points of adhesion between like components, even among component formulations that do not normally adhere well to each other, tend to limit separation between components that occurs in melt spinning processes in the absence of mechanical working or high pressure water jets. Nevertheless, by practice of the invention, splittable bicomponent and other multicomponent filaments that do not have a hollow core can be created. By judicious selection and placement of components, the areas of adhesion in the filament configuration can be reduced to facilitate splitting in the absence of mechanical working or high pressure water jets. The segmented pie configuration of the Hills patent at FIG. 43 and variations thereon in FIGS. 44 through 47 should also be useful in preparing such a multicomponent filament.

Figure 3:
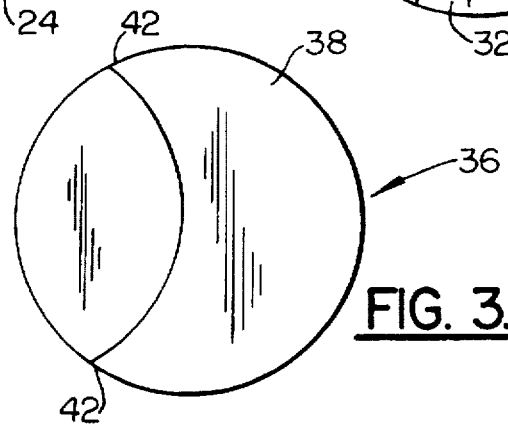
FIG. 3 illustrates a bicomponent thermoplastic continuous filament of the invention in a side-by-side configuration.

Shown in FIG. 3 is a transverse section through a bicomponent filament 36 in a side-by-side configuration and having components 38 and 40. There are no areas of contact between like component segments in the side-by-side configuration. Nevertheless, the side-by-side configuration does not typically separate in melt spinning processes. In the side-by-side configuration, one component 38 tends to hold the other component 40 within its grasp at the endpoints 42 of the component. By judicious selection of components and conditions, as discussed below, at least some separation of the filaments can occur.

The invention is not limited to hollow core and solid core multicomponent filaments and their separation to form smaller filaments. Hollow and solid core multicomponent thermoplastic continuous filaments can be prepared in accordance with the invention and in the absence of mechanical drawing or application of high pressure water jets that typically do not separate to the same degree as other hollow component filaments and solid core multicomponent filaments made in accordance with the invention. So long as the lower melting component does not encapsulate the higher melting component, then, by judicious selection of components that do not adhere well to each other, multicomponent filaments can be produced having some degree of separation as they exit the spinneret and are attenuated with a fluid.

Fine filaments, including sub-denier and micro-filaments of one or more components, can be produced if the filament components are small in diameter. Sub-denier filaments typically have deniers in the range of 1 denier per filament or less. Micro-filaments typically have deniers in the range of from about 0.1 to 0.3 denier per filament. Micro-denier filaments of low orientation have previously been obtained from relatively low molecular weight polymers by melt blowing. However, the invention provides continuous micro-denier filaments at commercial throughputs from relatively high molecular weight polymers.

Single webs can be produced of small and micro-denier filaments, the webs comprising at least two different components that are extruded through a single capillary of a spinneret, which yield fabrics of surprising properties. The invention can also be used to produce similar webs of filaments of more typical larger diameters.

Beneficial products can be produced with webs and fabrics made from these filaments. The extent of separation can be controlled to provide fabrics having excellent cover and barrier due to the numerous micro-denier filaments. The presence of larger multicomponent filaments can provide strength. These filaments can be used to produce nonwoven webs, continuous filament textile yarns, or tow for staple where it is desired to impart useful properties of multiple polymers to the filaments in a single process line. Separate production of monocomponent filaments can be avoided.

Nonwoven articles produced in accordance with the invention have surprising strength, softness, and barrier. For example, a hollow core filament of nylon and polyethylene can be spunbonded in accordance with the invention to produce a single layer web containing separate filaments of nylon and polyethylene, the nylon providing a component of strength that would not otherwise be present. Filament size can be controlled to provide softness, barrier, and cover.

Nonwoven fabrics made with the splittable filaments of the invention should be particularly useful as components for disposable absorbent articles, including diaper components, other sanitary products, and wipes; medical barrier fabrics, including garments and wraps; and filtration media.

A diaper topsheet of unexpected strength, uniformity, and softness can be prepared in accordance with the invention.

A softer topsheet provides improved comfort to the baby or incontinent adult. Improved strength and uniformity allows the use of lower basis weight fabrics as topsheet. Problems of glue bleedthrough and loss of super absorbent polymer from the diaper core are avoided. Polymers or additives to the polymers can be chosen to control hydrophilicity. A topsheet constructed so as to control hydrophilicity would no longer require topical treatment with expensive chemicals that can easily wash off and increase the chance for diaper leakage.

Diaper top sheet, back sheet, and leg cuff can be made by practice of the invention that are softer and have improved strength and barrier properties for the same basis weight or similar properties at lower basis weight when compared to similar nonwoven articles made by prior processes.

Spunbonded webs made from splittable micro-filaments of the invention or laminates of these spunbonded webs combined with meltblown fiber webs can be expected to produce fabrics with superior barrier compared to current spunbonded webs and laminates with meltblown. Barrier fabrics of the invention should be useful for leg cuffs at reduced basis weight and therefore at reduced cost. Redmarking of the baby's or adult's legs should be reduced due to the superior softness of leg cuff products made with the spunbonded fabrics of the invention.

Diaper backsheet comprised of the spunbonded fabrics made from splittable filaments can be expected to show improved barrier, opacity, and softness.

Bonding non-woven fabrics made in accordance with the invention can be accomplished using a variety of methods, including a calendering system, hot through-air methods, adhesive bonding, sonic bonding, and needling techniques. Through-air methods should produce a fabric of surprising loft and bulkiness that is suitable for diaper and sanitary product inner layers for acquisition and distribution of body fluids.

Splittable filaments of the invention and laminates with meltblown fibers or films should also find use in preparing protective clothing with superior comfort, breathability, and protection from hazardous materials. For example, disposable medical garments and medical equipment wraps for use in operating rooms can be expected to show superior barrier when made from spunbonded webs of splittable filaments, and yet can be expected to be soft and comfortable to wear. These products can be made stable to gamma radiation by a judicious selection of polymers, such as polyethylene and polyester.

The unexpected ability to produce micro-denier filaments of different polymeric components in a single layer in a web should also be useful in the preparation of filters. Polymer compositions and filament size can be controlled to produce long life filters with a unique, tailored filtration capability for filtering lubrication oils and the like.

It should also be possible to incorporate polymers in the multicomponent configuration that will produce highly elongatable fabrics for use with elastic members to improve the fit of garments made from nonwoven webs.

The polymers and multicomponent filament configurations that are used to prepare the nonwovens mentioned above could also be used to prepare textile yarns and tow for stable fibers. Filaments for textile yarns typically would be transported through a pneumatic device similar to a yarn texturing jet for air drawing.

Yarns made from the filaments of the invention, including the split filaments, could find use in carpets, upholstery, and drapes. The split filaments could be used to produce very fine denier filaments that would provide high covering power. Yarns and fibers prepared in accordance with the invention and woven and knit into garments would provide a soft texture resembling silk, particularly when prepared with the fine denier filaments. Fine denier split staple fibers would provide a suede-like texture when flocked onto a surface, such as that associated with ultrasuede fabric.

Figure 4:
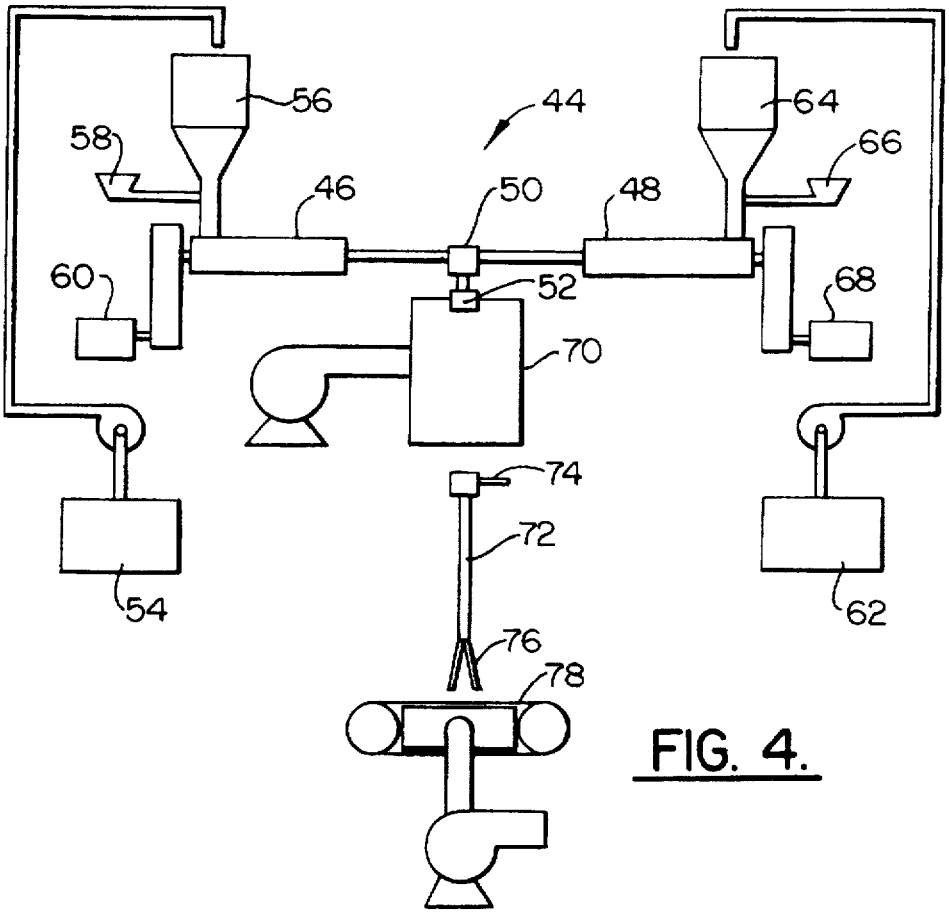
FIG. 4 illustrates in highly schematic form a melt spinning line for producing bicomponent filaments and then drawing the filaments through a Lurgi tube for deposit on a collection surface.
Figure 5:
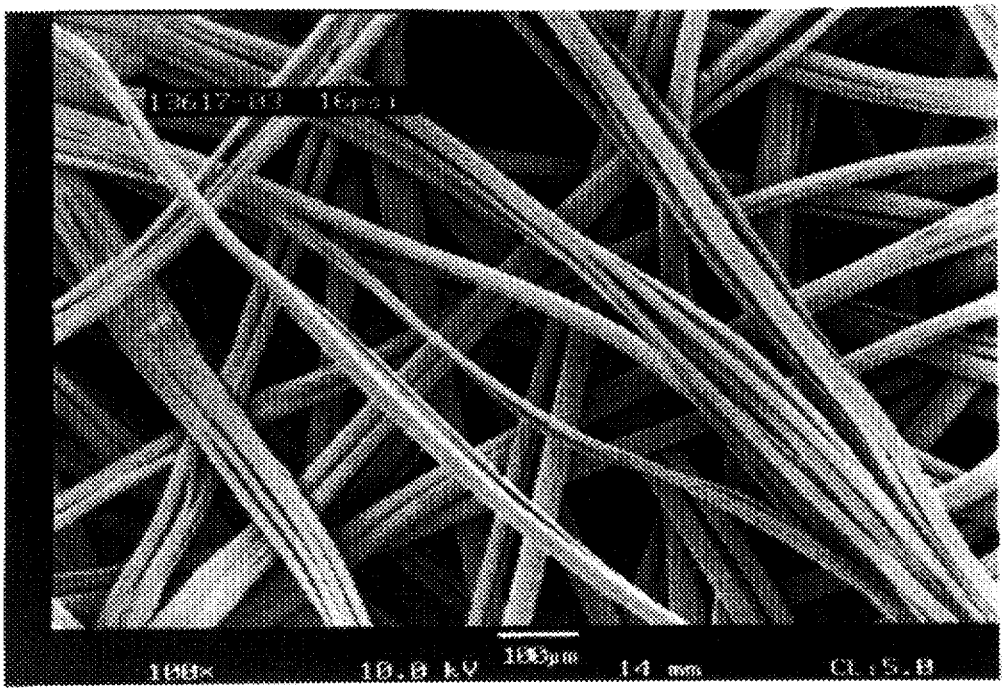
FIGS. 5 through 16 are photomicrographs at various levels of magnification showing various views of examples of filaments made in accordance with the invention.
Figure 6:
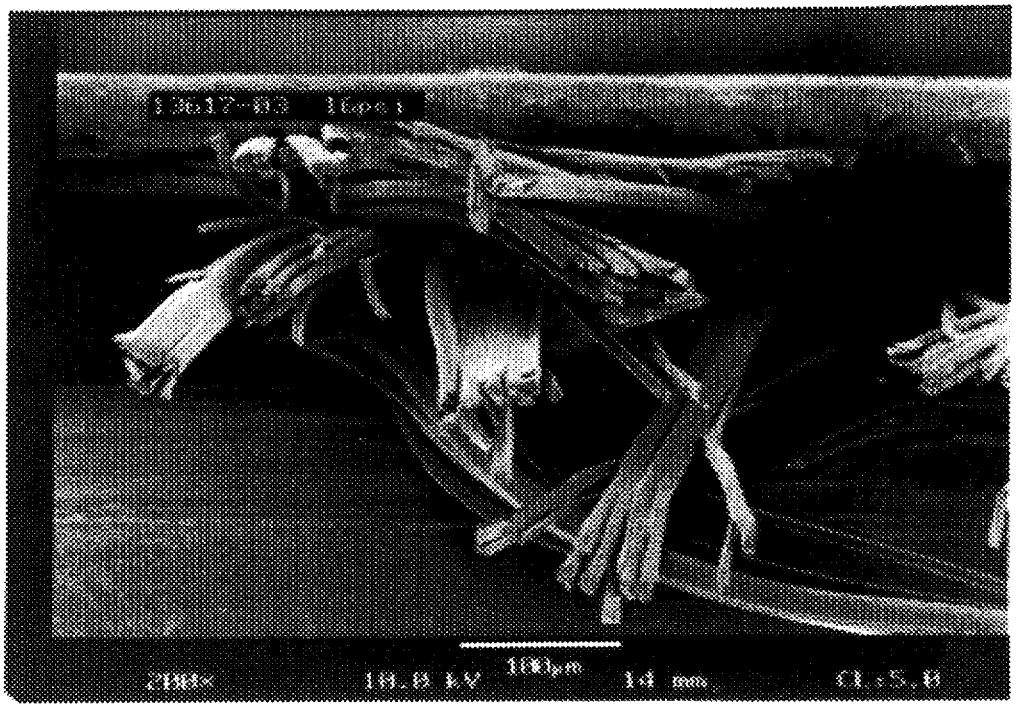
Figure 7:
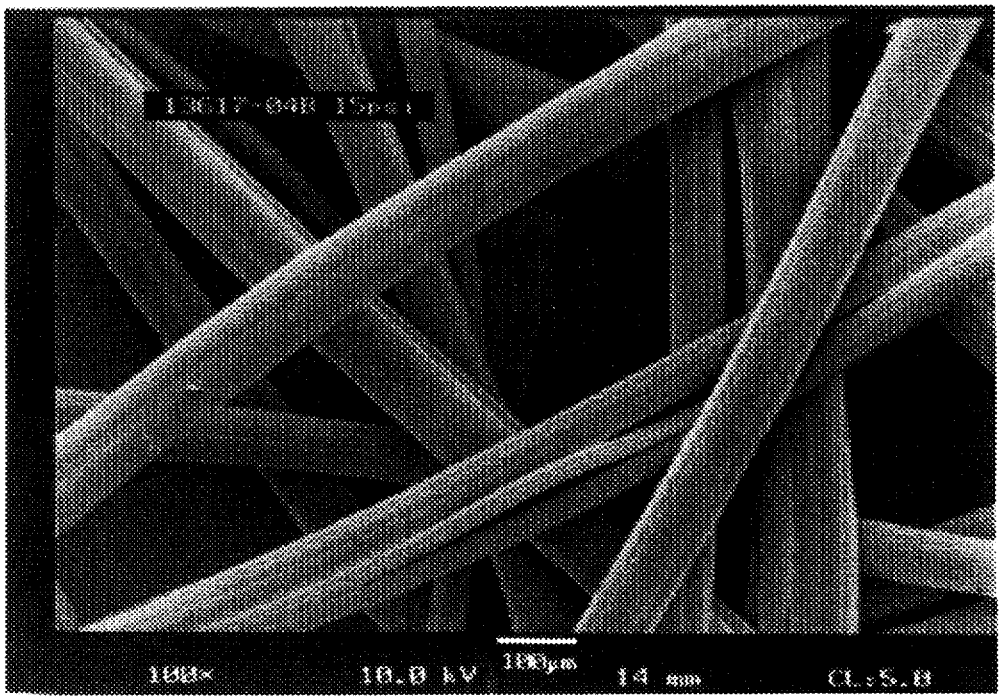

FIG. 4 is a schematic illustration of a melt spinning line 44 for producing bicomponent filaments in which two extruders 46 and 48 provide thermoplastic components to separate pumps, represented collectively at 50, for the spin pack 52. It should be recognized that additional extruders and pumps may be added as commercially practicable to increase the number of components. Solid thermoplastic polymer for a first component, typically in the form of pellets, is conveyed from a hopper 54. The polymer pellets are dried in a dryer 56, if needed. For example, nylon typically is dried; polyethylene and polypropylene are not usually dried. Additives are included as needed from a feeder 58 and the polymer is melted at a first temperature and extruded through extruder 46, which is driven by a motor 60. The polymer melt for the first component is then conveyed to the spin pack through a spinning pump.

A second solid thermoplastic polymer is conveyed from a hopper 62. If necessary, this second polymer is dried in a dryer 64. Additives are added as desired from a feeder 66. The second polymer is melted at a second temperature and extruded through extruder 48, which is driven by a motor 68. The extruder provides the second component to a pump at 50. The pump provides the second component to the same spin pack 52 as the first component. The first and second polymer melt temperatures may be the same or different, depending upon the circumstances.

The polymers come together in the spin pack 52, usually with the same melt temperature, which is dictated by the higher melting component and typically is at the lower end of the melting range for the higher melting component. Component throughput is at a speed fast enough to avoid degradation of the lower melting component.

The polymers should be selected to have melting temperatures and should be spun at a polymer throughput that enables the spinning of the components through a common capillary at substantially the same temperature without degrading one of the components.

For example, nylon is typically extruded at a temperature of approximately 250 to 270 degrees Centigrade. Polyethylene and polypropylene typically are extruded at a temperature of approximately 200 to 230 degrees Centigrade. The polymers come together in the spin pack at the same capillary at a temperature of about 250 degrees Centigrade and are spun at a polymer throughput that avoids degradation of the lower melting component.

The spin pack can be any of several available for production of bicomponent and other multicomponent filaments. One suitable spinpack is that described in Hills U.S. Pat. No. 5,162,074, the contents of which are incorporated herein by reference in their entirety. A hollow hole spinneret for producing the desired number of component segments may be incorporated in the apparatus to receive the separate polymeric components and to spin the bicomponent filaments therefrom.

The bicomponent filaments are spun through the spin pack and quenched in a quench chamber 70. As shown in the tables below and in photomicrographs, filaments can be prepared in accordance with the invention that separate at least to some degree, if not entirely, upon exiting the spinneret or in response to very low pressure attenuation. Conventional Lurgi air attenuation pressures are in the neighborhood of from about 200 to 275 psig. Splitting can occur in accordance with the present invention in free fall and at pressures as low as from about 7 to 20 psig. Lower air attenuation pressure can be expected greatly to reduce the costs of preparing the splittable filaments of the invention.

Crystallization can occur at different rates or to different degrees and result in separation at the spinneret. Differences in crystallization rates are important in choosing the polymer components. Nylon usually crystallizes immediately on exiting the spinneret. Polyethylene usually solidifies three to four inches downstream. These differences enhance the ability of the filaments to separate. In some processes, it may be desirable not to attenuate the filaments at typical pressures, but to collect them from free fall or after transport through a low pressure gaseous medium.

The filaments can also be attenuated in a gaseous medium, including, for example, air or steam. A number of apparatuses are available for this purpose, as is believed to be well known to the skilled artisan. For example, the invention can be applied to slot draw apparatus and methods wherein the filaments exit the quench chamber from a spinning beam to enter an elongate slot for stretching by attenuation and drawing.

electric field to the filaments exiting a slot draw attenuator is shown in Trimble et al. U.S. Pat. No. 5,397,413, the contents of which are incorporated herein by reference in their entirety.

After spinning, attenuation if desired, and electrical treatment if desired, the filaments are deposited on a collection surface such as a lay down table 74 to form a nonwoven web, or are collected to form continuous filament yarn or tow for staple. Typically, a collection surface will be a perforated screen or similar device through which vacuum can be applied to further assist in controlling web lay down.

The web is typically bonded and rolled after the filaments are collected. Bonding usually is accomplished by passing through a calender nip defined by at least one patterned roll, by through air bonding, by adhesive bonding, or by sonic bonding.

Table 1 shows a number of samples produced in accordance with the present invention comprising various proportions of a higher melting nylon component and a lower melting polypropylene or polyethylene component at various conditions. Sample No. 13617-05, Table 1, is a free fall example in which the filaments split upon exiting the spinneret.

TABLE 1

| Sample # | Description | Comments | BS.WT. (gsm) | Peak Load MD-(g) | Elong at Max MD-(%) | Peak Load CD-(g) | Elong at Max CD-(%) | Denier |
|---|---|---|---|---|---|---|---|---|
| 13617-03 | 18% Nylon 6/82% PP 12-MFR | | 27.81 | 2605 | 88.48 | 1383 | 66.83 | .42/.95 |
| 13617-04A | 20% Nylon 6/80% PP 12-MFR | 10-psi | 21.31 | 1404 | 24.79 | 1072 | 37.41 | .44/1.06 |
| 13617-04B | 20% Nylon 6/80% PP 12-MFR | 15-psi Closer Gap | 24.35 | 1793 | 27.89 | 1413 | 31.36 | |
| 13617-04C | 20% Nylon 6/80% PP 12-MFR | 15-psi | 13.42 | 643.4 | 16.38 | 387.1 | 27.84 | .43/1.14 |
| 13617-05A | 10% Nylon 6/90% PP 12-MFR | 12-psi | 19.1 | 1130 | 15.24 | 1251 | 38.44 | .53/1.25 |
| 13617-05B | 10% Nylon 6/90% PP 12-MFR | 20-psi | 17.99 | 1096 | 17.36 | 1110 | 34.28 | .41/.89 |
| 13617-06 | 20% Nylon 6/80% PE | 7-psi | 29.75 | 4592 | 87.14 | 2304 | 69.56 | .49/.92 |
| 13617-07 | 10% Nylon 6/90% PE | 7-psi | 30.86 | 2986 | 74.41 | 2246 | 57.77 | 7.88 |
| 13617-08A | 10% Nylon 6/90% PE | 7-psi | 47.46 | 3712 | 79.05 | 3686 | 63.2 | 10.81 |
| 13617-08B | 10% Nylon 6/90% PE | 22-psi | 19.93 | 1796 | 58.7 | 1651 | 54.37 | 8.81 |
| 13617-08C | 10% Nylon 6/90% PE | Higher Line Speed | 22.14 | 2106 | 54.04 | 1971 | 53.25 | |
| 13617-08D | 10% Nylon 6/90% PE | 10-psi | 41.24 | 3646 | 70.05 | 3895 | 69.66 | 8.94 |
| 13617-08E | 10% Nylon 6/90% PE | 12.5 | 40.82 | 4003 | 68.26 | 4223 | 63.77 | 7.11 |
| 13617-08F | 10% Nylon 6/90% PE | 20-psi | 40.54 | 3548 | 64.25 | 3998 | 57.43 | |
| 13617-09A | 10% Nylon 6/90% PE | 20-psi Lower T.P. | 18.4 | 1470 | 63.08 | 1846 | 68.4 | 8.45 |
| 13617-09B | 7.5% Nylon 6/92.5% PE | 20-psi Higher T.P. | 19.37 | 1469 | 59.3 | 1756 | 59.46 | 5.66 |

As shown in FIG. 4, after exiting the quench chamber, the filaments enter a Lurgi tube 72. Compressed air 74 is supplied to the Lurgi tube to stretch the filaments by drawing and attenuating them. The turbulent compressed air of the Lurgi tube augments the separation. Separation is favored by increased turbulence.

A triboelectric charge can be developed in the filaments to promote separation. A nylon component can develop such a static charge.

An external electric field can be applied to the filaments. The filaments can be subjected to an electric charge to augment the separation and assist in controlling web laydown, particularly where the filament components have different conductive properties. For example, a method and apparatus for electrostatic treatment by corona discharge that is suitable for use with a Lurgi tube attenuator is disclosed in Zeldin et al. U.S. Pat. No. 5,225,018, the contents of which are incorporated herein by reference in their entirety. Such an apparatus for applying a corona discharge to the filaments is represented in FIG. 4 at 76. A suitable apparatus and method for applying an external All of the webs shown in Table 1 are prepared by spunbonding using a point calender bond. The strip tensile test used to evaluate the surprising increases in strength of these webs is evaluated by breaking a one inch by seven inch long sample generally following ASTM D1682-64, the One-Inch Cut Strip Test. The instrument cross-head speed was set at five inches per minute and the gauge length was set at five inches. The tensile strength in both the machine direction ("MD") and cross direction ("CD") was evaluated. The strip tensile strength or breaking load, reported as grams per inch is the average of at least 5 measurements.

As seen in Table 1, many of the filaments are separated into micro-denier filaments of diameters of average denier from 0.41 to 1.25. Some encapsulation occurred with the polyethylene component which resulted in the filaments not fully separating in many of the examples, which is believed to have been due to the amount of nylon used in these examples as compared to the examples with nylon and polypropylene. Nevertheless, products with surprising properties still result. Maximum tensile values in both the machine and cross directions are much higher for the basis weight than for comparable fabrics made from a single polymer.

Figure 8:
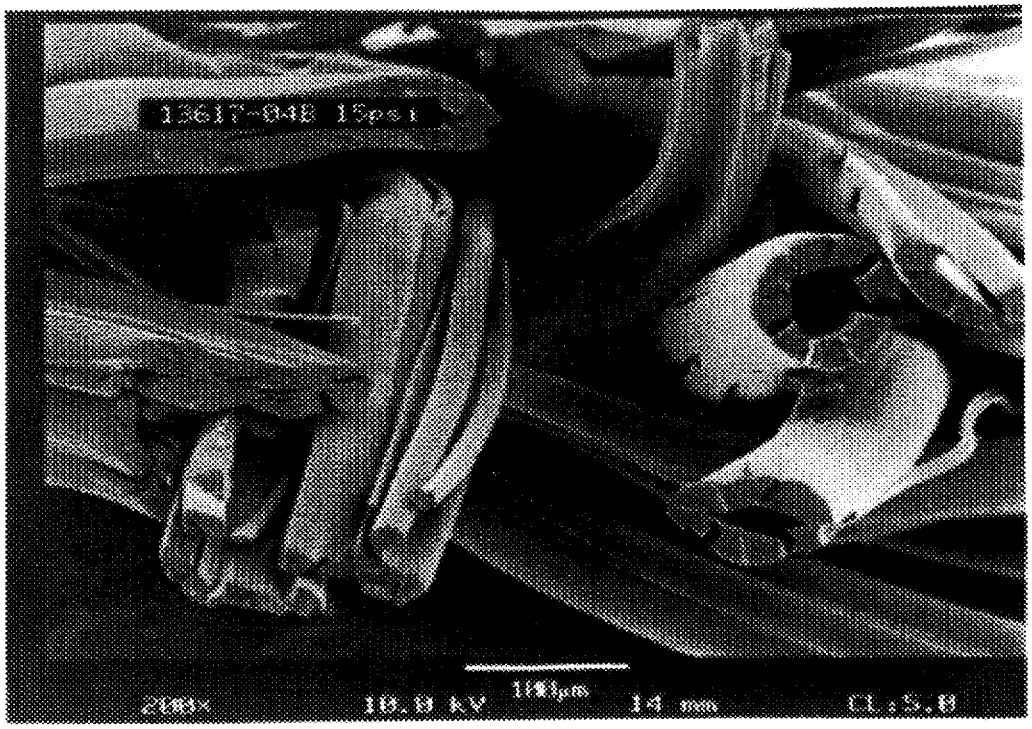
Figure 9:
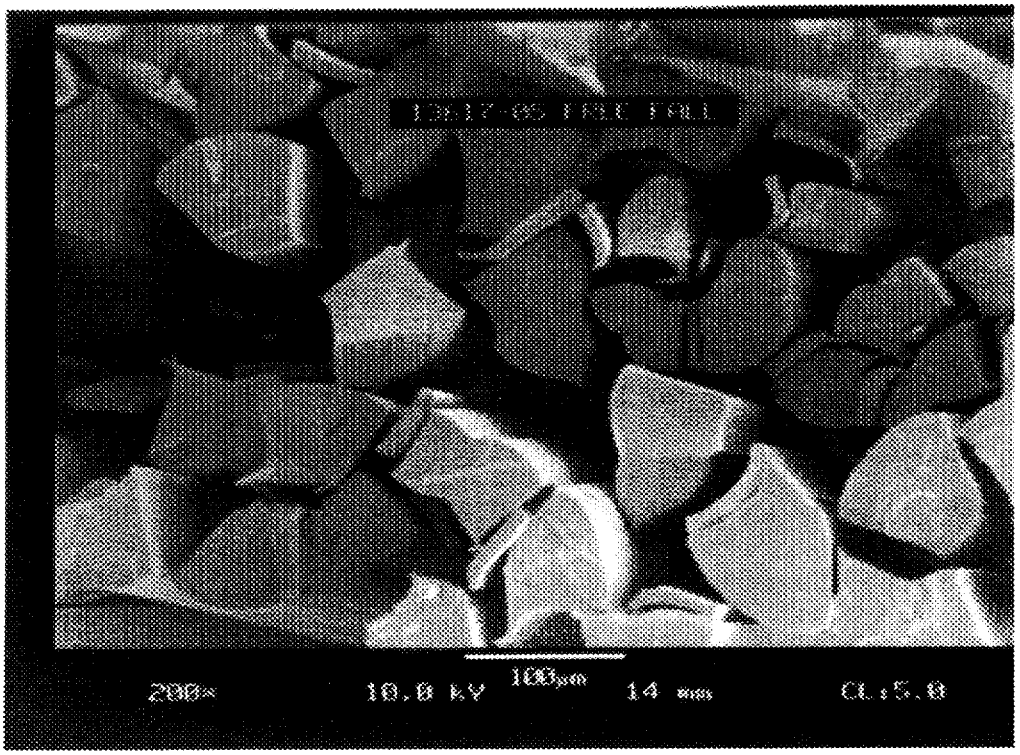
Figure 10:
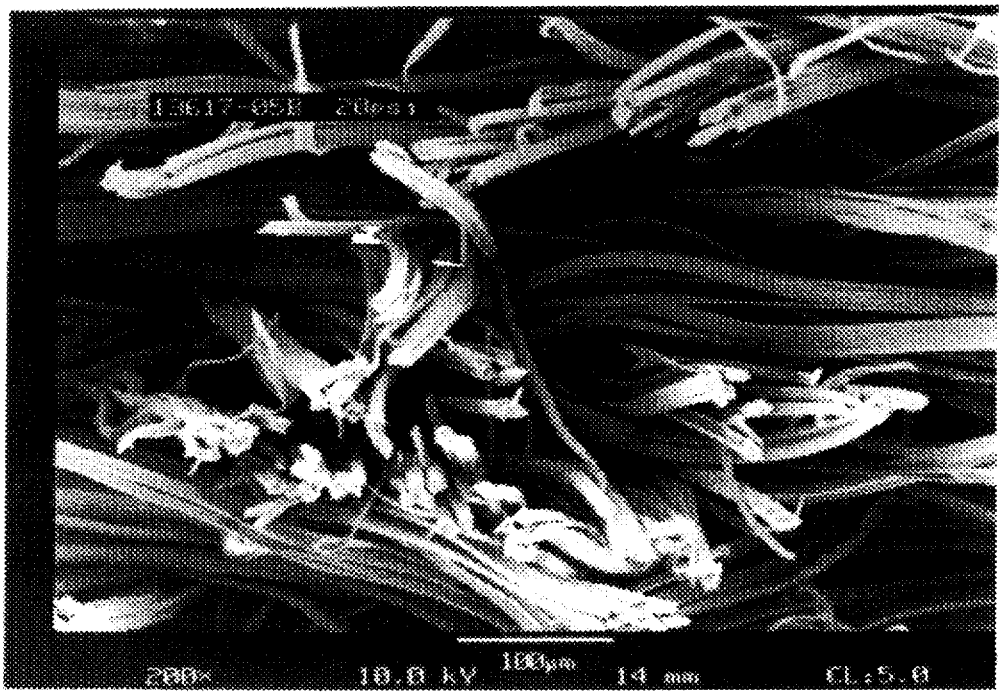
Figure 11:
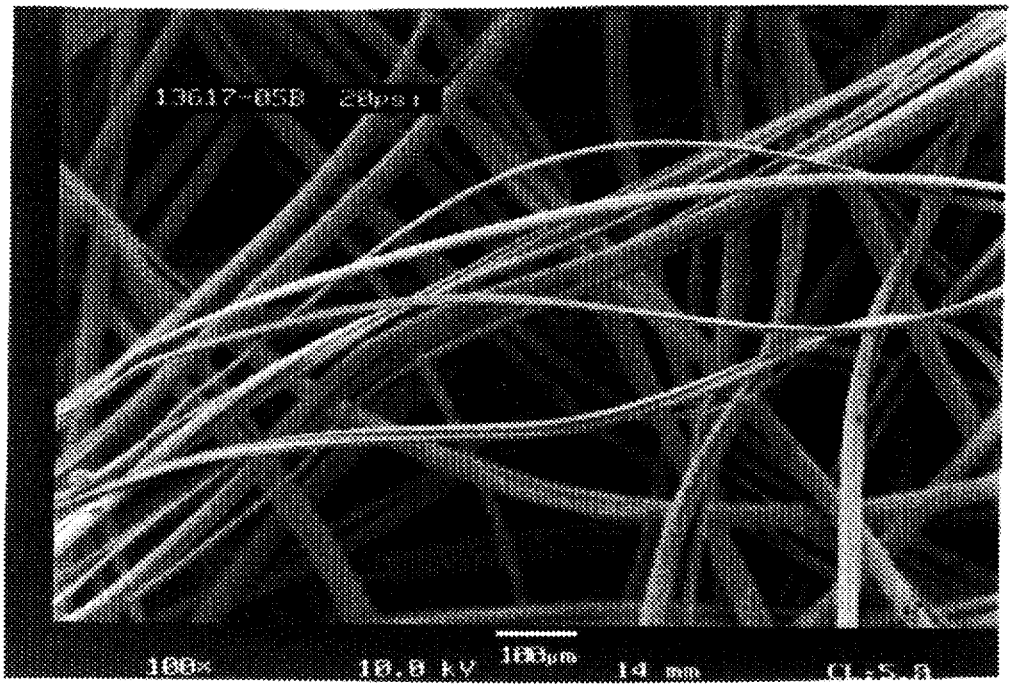
Figure 12:
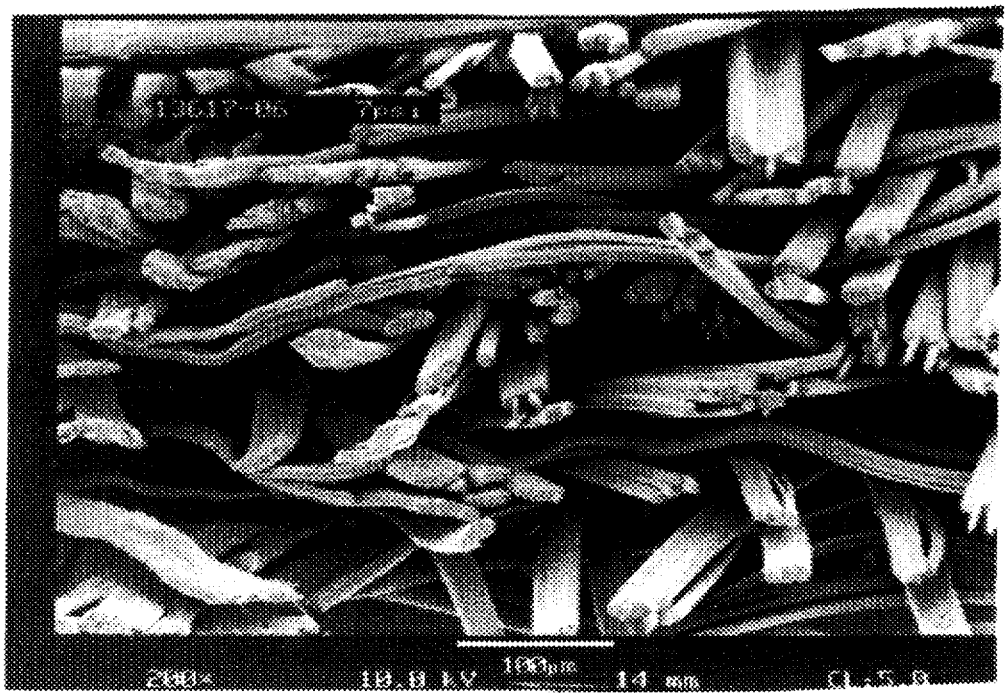
Figure 13:
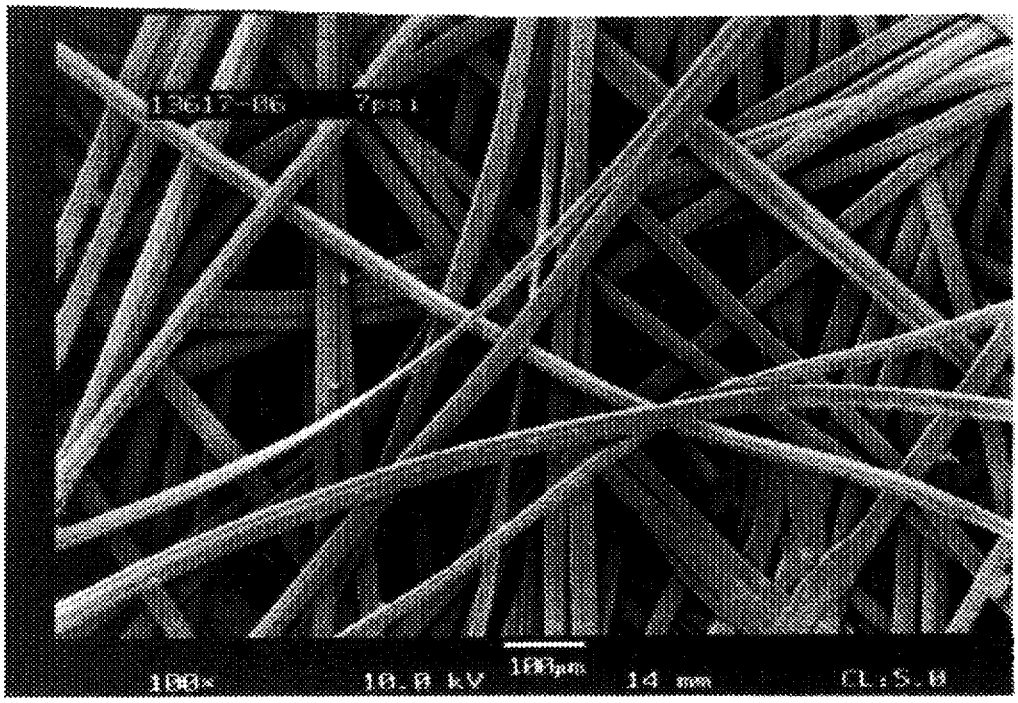
Figure 14:
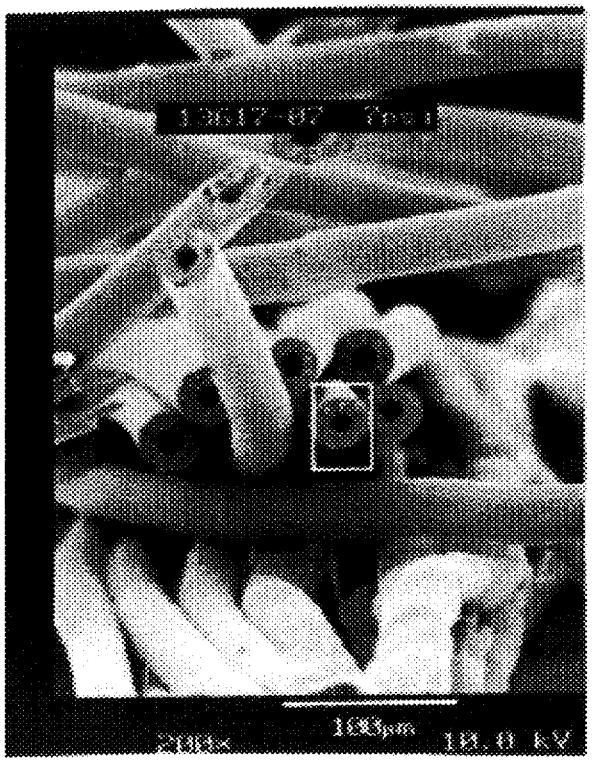
Figure 15:
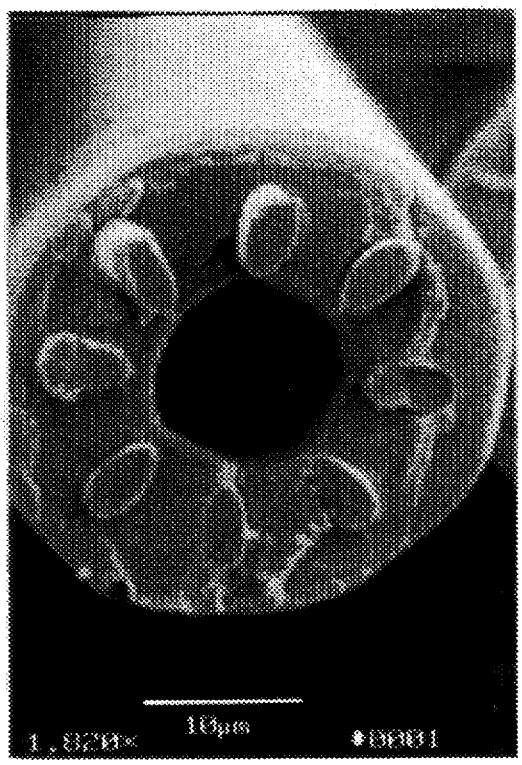
Figure 16:
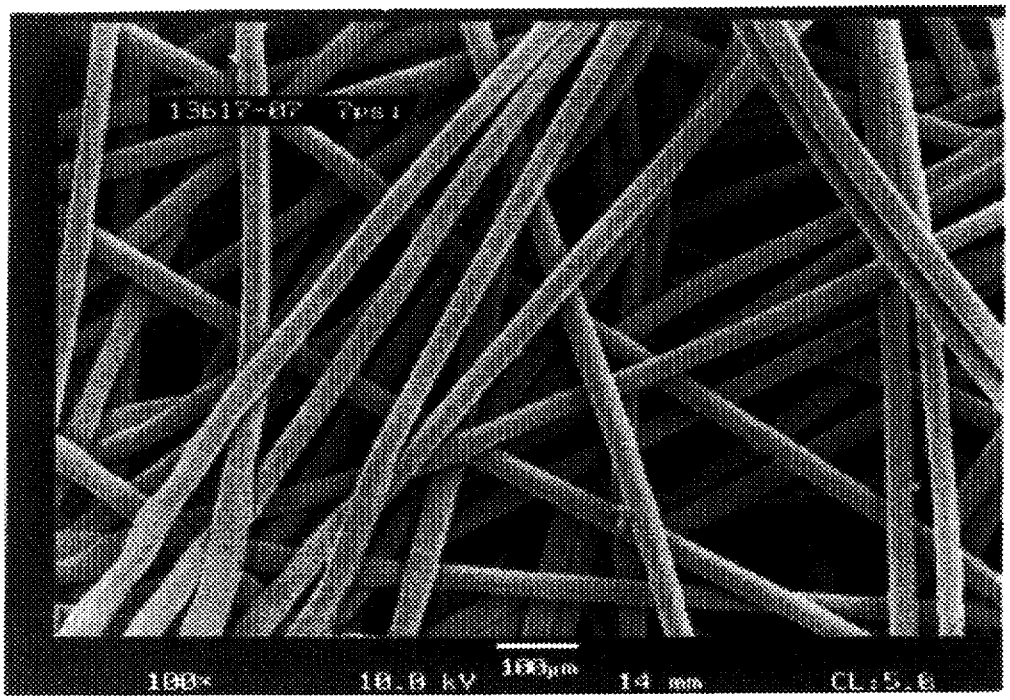

FIGS. 5 through 15 are photomicrographs of various examples of multicomponent thermoplastic continuous filaments made in accordance with the invention and corresponding to like numbered examples presented in Table 1. Two views typically are presented, one showing a top view of the split filaments, and one showing the end view. FIG. 8 shows some of the filaments beginning to split after transport through air at a pressure of 15 psig. FIGS. 14 and 15 show an example of encapsulation of one of the components by another in a hollow multicomponent filament.

Table 2 shows a physical property comparison of a typical polypropylene spunbonded product with splittable filaments of the invention prepared from polypropylene and nylon bicomponent. Strip tensile strength was evaluated by the same method as reported above for Table 1 for fabrics of basis weight 30 grams per square meter. The splittable bicomponent is that of example 13617-06 which produced a splittable nylon and polyethylene bicomponent having individual filaments of micro-denier size.

TABLE 2

Physical Property Comparison

| Sample ID. | Basis Weight (g/m2) | CD Tensile (g/in) | CD TEA (gcm/cm2) | MD Tensile (g/in) | R.C.S.T. (mm) | Throughput (g/h/m) |
|---|---|---|---|---|---|---|
| Typical Polypropylene Spunbonded | 30 | 1273 | 217 | 2790 | 103 | 0.6 |
| Splittable Spunbonded | 30 | 2304 | 457 | 4592 | 197 | 0.6 |

As can be seen, the strip tensile strength in the cross direction and in the machine direction greatly exceeded that of a typical polypropylene spunbonded by over 50 percent. The cross direction total energy absorption ("TEA"), which is a measure of the toughness of the fabric and is an evaluation of the area under a stress-strain curve for the fabric was also greatly increased for the splittable example.

Rising column strikethrough ("R.C.S.T."), is an evaluation of the barrier properties of the fabric. Barrier was improved by over 90 percent. All of these benefits were achieved at a polymer throughput that was comparable for a typical polypropylene spunbonded.

It should be apparent from the above that composite structures can be prepared using the method and fabrics of the invention having the same physical properties as prior structures at greatly reduced basis weight, or significantly improved physical properties at comparable basis weights. These fabrics can be prepared at commercially significant throughputs by a single process that provides for both barrier properties, strength, and coverage.

The foregoing description is to be considered illustrative rather than restrictive of the invention. While this invention has been described in relation to its specific embodiments, it is to be understood that various modifications thereof will be apparent to those of ordinary sill in the art upon reading the specification and it is intended to cover all such modifications that come within the meaning and range of equivalents of the appended claims.

What is claimed is:

1. A nonwoven web comprising at least first and second individual spun-laid or spun-bonded microfilaments comprising at least a first component and a second component, respectively, wherein the first and second components are different from each other, and wherein the individual filaments originate from a common capillary.

2. The nonwoven web of claim 1 wherein said first and second components are polymeric components selected from the group consisting of polyolefins, polyamides, polyesters, polycarbonates, polyurethanes, thermoplastic elastomers, copolymers thereof, and mixtures of any of these with additives that alter the surface energy of the polymer, copolymer, or elastomer to promote splitting.

3. The nonwoven web of claim 1 wherein said first and second components are polymeric components selected from the group consisting of polyester, polypropylene, polyethylene, nylon, thermoplastic elastomers, copolymers thereof, and mixtures of these with additives that alter the crystallization properties or electrically conductive properties of the polymer, copolymer, or elastomer to promote splitting.

4. The nonwoven web of claim 1 wherein said individual filaments originate from a common capillary as a hollow multicomponent filament.

5. The nonwoven web of claim 1 wherein said individual filaments originate from a common capillary and separate along at least a portion of their length prior to depositing on a collection surface to form a nonwoven web.

6. The nonwoven web of claim 5 wherein the individual filaments separate along at least a portion of their length by splitting selected from the group consisting of splitting in free fall upon exiting a spinneret, splitting by transporting extruded filaments through a pressurized gaseous stream, splitting by developing a triboelectric charge in at least one of the components, splitting by applying an external electrical field to the filaments, and splitting by a combination of any two or more of these.

7. A product comprising the nonwoven web of claim 1 selected from the group consisting of disposable absorbent articles, medical barrier fabrics, and filtration media.

8. A nonwoven web comprising at least filaments comprising a first component and separate filaments comprising a second component wherein the filaments of the first and second components originate from a common capillary and separate along at least a portion of their length prior to depositing on a collection surface to form a nonwoven web.

9. The nonwoven web of claim 8 wherein said first and second components are polymeric components selected from the group consisting of polyolefins, polyamides, polyesters, polycarbonates, polyurethanes, thermoplastic elastomers, copolymers thereof, and mixtures of any of these with additives that alter the surface energy of the polymer, copolymer, or elastomer to promote splitting upon exiting the capillary.

10. The nonwoven web of claim 8 wherein said first and second components are polymeric components selected from the group consisting of polyester, polypropylene, polyethylene, nylon, thermoplastic elastomers, copolymers thereof, and mixtures of these with additives that alter the crystallization properties or electrically conductive properties of the polymer, copolymer, or elastomer to promote splitting upon exiting the capillary.

11. The nonwoven web of claim 8 wherein said filaments of the first and second components originate from a common capillary as a hollow multicomponent filament.

12. The nonwoven web of claim 8 wherein said filaments of the first and second components originate from a common capillary and separate along at least some portion of their length prior to depositing on a collection surface to form a nonwoven web by splitting selected from the group consisting of splitting in free fall upon exiting a spinneret, splitting by transporting extruded filaments through a pressurized gaseous stream, splitting by developing a triboelectric charge in at least one of the components, splitting by applying an external electrical field to the filaments, and splitting by a combination of any two or more of these.

13. The nonwoven web of claim 8 wherein said filaments of the first and second components comprise microfilaments.

14. A product comprising the nonwoven web of claim 8 selected from the group consisting of disposable absorbent articles, medical barrier fabrics, and filtration media.

15. A nonwoven web comprising spun-laid or spunbonded multicomponent, thermoplastic continuous filaments, at least a portion of which are split along at least some portion of their length prior to depositing on a collection surface to form a web.

16. The nonwoven web according to claim 15 wherein said filaments split along at least some portion of their length prior to depositing on a collection surface to form a nonwoven web by splitting selected from the group consisting of splitting in free fall upon exiting a spinneret, splitting by transporting extruded filaments through a pressurized gaseous stream, splitting by developing a triboelectric charge in at least one of the components, splitting by applying an external electrical field to the filaments, and splitting by a combination of any two or more of these.

17. The nonwoven web according to claim 15 wherein said web comprises microfilaments.

18. The nonwoven web according to claim 15 wherein said web comprises filaments selected from the group consisting of microfilaments, multicomponent filaments, single component filaments, and mixtures thereof.

19. The nonwoven web of claim 15 wherein said spunlaid or spunbonded multicomponent, thermoplastic continuous filaments are hollow.

* * * * *